US008960316B2

(12) United States Patent
Greci

(10) Patent No.: US 8,960,316 B2
(45) Date of Patent: Feb. 24, 2015

(54) INTERVENTIONLESS ADJUSTABLE FLOW CONTROL DEVICE USING INFLATABLES

(71) Applicant: Halliburton Energy Services, Inc., Houston, TX (US)

(72) Inventor: Stephen Michael Greci, McKinney, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/983,771

(22) PCT Filed: Oct. 24, 2012

(86) PCT No.: PCT/US2012/061506

§ 371 (c)(1),
(2) Date: Aug. 5, 2013

(87) PCT Pub. No.: WO2014/065788

PCT Pub. Date: May 1, 2014

(65) Prior Publication Data

US 2014/0332229 A1 Nov. 13, 2014

(51) Int. Cl.

| | |
|---|---|
| ***E21B 34/08*** | (2006.01) |
| ***E21B 33/10*** | (2006.01) |
| ***E21B 34/06*** | (2006.01) |

(52) U.S. Cl.

CPC ..... *E21B 33/10* (2013.01); *E21B 34/06* (2013.01)

USPC ..... 166/387; 166/319; 166/373; 166/386

(58) Field of Classification Search

CPC ..... E21B 34/08; E21B 34/10; E21B 33/127; E21B 43/12; E21B 43/14; E21B 34/06; E21B 33/10

USPC ..... 166/386, 387, 195, 50, 373, 319; 137/517, 601.13, 601.2

See application file for complete search history.

(56) References Cited

U.S. PATENT DOCUMENTS

| | | | | |
|---|---|---|---|---|
| 2004/0238168 | A1 | 12/2004 | Echols | |
| 2006/0042801 | A1 * | 3/2006 | Hackworth et al. | 166/387 |
| 2006/0169463 | A1 | 8/2006 | Howlett | |
| 2009/0008078 | A1 * | 1/2009 | Patel | 166/50 |

(Continued)

OTHER PUBLICATIONS

Foreign Communication from a Related Counterpart Application, International Search Report and Written Opinion, Apr. 29, 2013, International Application No. PCT/US12/61506 filed on Oct. 24, 2012.

*Primary Examiner* — Jennifer H Gay
*Assistant Examiner* — George Gray
(74) *Attorney, Agent, or Firm* — Scott Richardson; Baker Botts L.L.P.

(57) ABSTRACT

A flow control device comprises a fluid pathway configured to provide fluid communication between an exterior of a wellbore tubular and an interior of the wellbore tubular, a flow restriction disposed in the fluid pathway, a one-way valve disposed in the fluid pathway to substantially block fluid flow from the interior of the wellbore tubular to the fluid pathway and to allow fluid flow from the fluid pathway to the interior of the wellbore tubular, and an inflatable seal disposed between an opening to the interior of the wellbore tubular and the fluid pathway, wherein the inflatable seal is configured to inflate to substantially block the fluid pathway in response to a fluid pressure differential between the interior of the wellbore tubular and the exterior of the wellbore tubular that exceeds a predefined threshold.

20 Claims, 5 Drawing Sheets

(56) References Cited

U.S. PATENT DOCUMENTS

2009/0084556 A1 4/2009 Richards et al.
2010/0186969 A1 7/2010 Metcalfe
2011/0030969 A1* 2/2011 Richards ..... 166/373

* cited by examiner

INTERVENTIONLESS ADJUSTABLE FLOW CONTROL DEVICE USING INFLATABLES

CROSS-REFERENCE TO RELATED APPLICATIONS

This application is a national stage of and claims priority under 35 U.S.C. §371 to International Patent Application Serial No. PCT/US12/61506, filed on Oct. 24, 2012, entitled "Interventionless Adjustable Flow Control Device Using Inflatables," by Stephen Michael Greci, which is incorporated herein by reference for all purposes.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Wellbores are sometimes drilled into subterranean formations to produce one or more fluids from the subterranean formation. For example, a wellbore may be used to produce one or more hydrocarbons. Additional components such as water may also be produced with the hydrocarbons, though attempts are usually made to limit water production from a wellbore or a specific interval within the wellbore. Other components such as hydrocarbon gases may also be limited for various reasons over the life of a wellbore.

Where fluids are produced from a long interval of a formation penetrated by a wellbore, it is known that balancing the production of fluid along the interval can lead to reduced water and gas coning, and more controlled conformance, thereby increasing the proportion and overall quantity of oil or other desired fluid produced from the interval. Various devices and completion assemblies have been used to help balance the production of fluid from an interval in the wellbore. For example, inflow control devices (ICD's) have been used in conjunction with well screens to restrict the flow of produced fluid through the screens for the purpose of balancing production along an interval. For example, in a long horizontal wellbore, fluid flow near a heel of the wellbore may be more restricted as compared to fluid flow near a toe of the wellbore, to thereby balance production along the wellbore.

SUMMARY

In an embodiment, a flow control device is disclosed. The flow control device comprises a fluid pathway configured to provide fluid communication between an exterior of a wellbore tubular and an interior of the wellbore tubular, a flow restriction disposed in the fluid pathway, a one-way valve disposed in the fluid pathway to substantially block fluid flow from the interior of the wellbore tubular to the fluid pathway and to allow fluid flow from the fluid pathway to the interior of the wellbore tubular, and an inflatable seal disposed between an opening to the interior of the wellbore tubular and the fluid pathway, wherein the inflatable seal is configured to inflate to substantially block the fluid pathway in response to a fluid pressure differential between the interior of the wellbore tubular and the exterior of the wellbore tubular that exceeds a predefined threshold.

In an embodiment, a method is disclosed. The method comprises producing a fluid in a wellbore through a flow control device to an interior of a wellbore tubular, wherein the flow control device comprising at least one fluid pathway between an exterior of a wellbore tubular and an interior of the wellbore tubular, a port disposed in the fluid pathway, a one-way flow valve disposed to substantially block fluid flow from the interior of the wellbore tubular to the fluid pathway and to allow fluid flow from the fluid pathway to the interior of the wellbore tubular, and an inflatable seal disposed between an opening to the interior of the wellbore tubular and the fluid pathway. The method further comprises providing a pressure differential above a predefined threshold between the interior of the wellbore tubular and the exterior of the wellbore tubular, inflating the inflatable seal in response to the pressure differential above the predefined threshold, and substantially blocking fluid production through the port in response to inflating the inflatable seal.

In an embodiment, a method of adjusting fluid resistance to flow is disclosed. The method comprises producing a fluid in a wellbore through a first flow control device comprising at least one fluid pathway between an exterior of a first wellbore tubular and an interior of the first wellbore tubular, a flow restriction disposed in the fluid pathway, a first one-way flow valve disposed to substantially block fluid flow from the interior of the first wellbore tubular to the fluid pathway and to allow fluid flow from the fluid pathway to the interior of the first wellbore tubular, and a first inflatable seal disposed between an opening to the interior of the first wellbore tubular and the fluid pathway. The method further comprises producing a fluid in the wellbore through a second flow control device comprising a second wellbore tubular, wherein the first flow control device is coupled to the second flow control device by a portion of a tool string and wherein the interior of the first wellbore tubular and the interior of the second wellbore tubular are in fluid communication with each other. The method further comprises inflating the first inflatable seal in response to the pressure differential above the first predefined threshold and substantially blocking fluid production through the flow restriction by the first inflatable seal in response to inflating the first inflatable seal.

These and other features will be more clearly understood from the following detailed description taken in conjunction with the accompanying drawings and claims.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
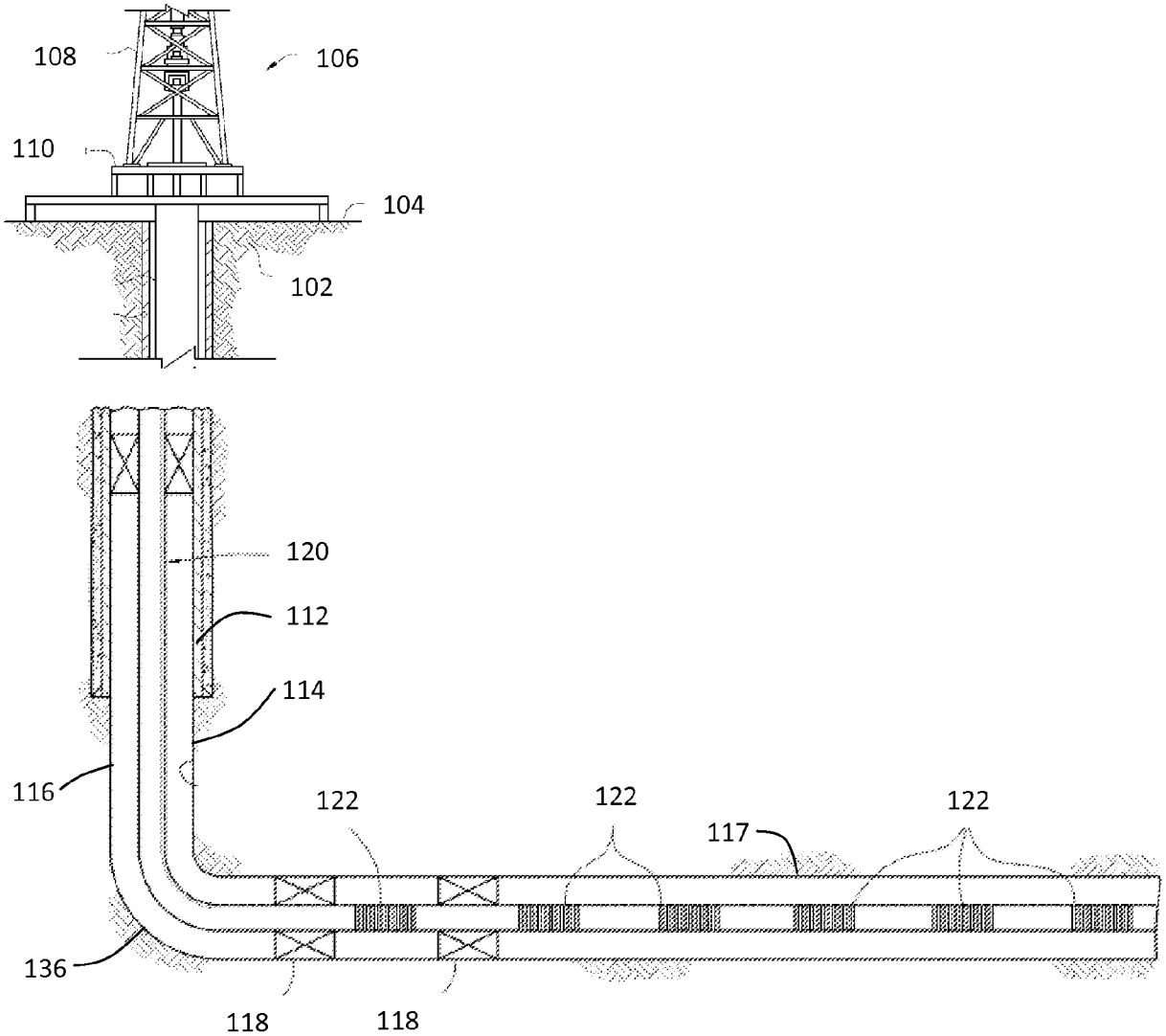
FIG. 1 is a cut-away view of an embodiment of a wellbore servicing system according to an embodiment.

In the drawings and description that follow, like parts are typically marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up," "upper," "upward," or "above" meaning toward the surface of the wellbore and with "down," "lower," "downward," or "below" meaning toward the terminal end of the well, regardless of the wellbore orientation. The various characteristics mentioned above, as well as other features and characteristics described in more detail below, will be readily apparent to those skilled in the art with the aid of this disclosure upon reading the following detailed description of the embodiments, and by referring to the accompanying drawings.

Disclosed herein is an adjustable flow control device for use in a wellbore, which may be used with an ICD. The flow control device may form a part of a well screen assembly and may comprise a fluid pathway that may be selectively adjusted downhole without intervention. In an embodiment, for example, the adjustment may be accomplished by pumping fluid down a tubular coupled to the flow control device to build a pressure differential between the interior of the flow control device and an exterior of the flow control device to at least a threshold pressure differential. The flow control device may comprise one or more flow restrictions in the flow path from the exterior to the interior of the flow control device. The flow restrictions may be implemented by different diameter ports, apertures, or fluid pathways. The size of the apertures may be determined by nozzles or chokes that are threaded into the body or housing of the flow control device.

In an embodiment a seal, for example a metal seal or a plastic seal, is coupled to the flow control device between a port open to the interior of the flow control device and one of the flow restrictions. When the pressure differential between the interior and the exterior of the flow control device exceeds a threshold, the seal inflates like a balloon, at least partially inelastically deforms, and engages the flow restriction, substantially blocking fluid flowing through the subject flow restriction. When pumping down the tubular is stopped, the seal retains its shape due to the inelastic deformation, continuing to substantially block flow through the subject flow restriction. In some contexts the seal may be referred to as an inflatable seal. In an embodiment, the seal may restore (e.g., deflate) slightly after the pressure differential has been reduced, but the seal may continue to substantially block fluid flow through the associated flow restriction. As disclosed herein, the inflatable seal responds to a pressure differential above a threshold across the inflatable seal caused by a fluid including both a gas and/or a liquid. Thus, the inflatable seal does not simply swell and/or elastically deform in contact with a fluid, but only deforms when a pressure differential above a threshold is placed across the seal, and the resulting deformation is at least partially inelastic so that the seal retains its shape and sealing configuration after the inflation.

When more than one flow restriction is present in the flow control device, a seal may be associated with each of the flow restrictions. The thickness and/or the elasticity of the seals may be selected during manufacture so that different seals expand when the pressure differential exceeds different thresholds. By selecting both the size of the flow restrictions and the pressure thresholds associated with each seal, the flow control device can be designed to be adjusted while it is deployed downhole in a completion configuration from the surface without intervention, other than pumping a pressure into the interior of a tubular at the surface.

In use, the inflatable seals may be used to transition between various states of the flow control device. For example, a flow control device may initially be open to flow, and a flow path within the flow control device may have a relatively low resistance to fluid flow. The flow control device may then be transitioned to a second, more restricted fluid flow by closing off one or more flow paths using the inflatable seal. In this embodiment, the pressure within the wellbore tubular may be increased above a first threshold, and one or more inflatable seals may expand to engage a fluid port, thereby substantially blocking fluid flow through the fluid port. The inelastic deformation of the inflatable seal may allow the seal to remain engaged with the port even after the pressure is reduced below a threshold. Fluid flow may then be directed through an inflow control device such as a fluid choke to provide a desired fluid resistance.

The inflatable seal may then be used to transition the flow control device to a closed state. In this embodiment, the pressure within the wellbore tubular may be increased above a second threshold, and one or more additional inflatable seals that did not respond to the pressure increase above the first threshold, may expand to engage additional fluid ports. Substantially all of the fluid ports through the flow control device may be closed, thereby substantially blocking fluid flow through the flow control device. While an example is provided of two states, any number of states or flow paths may be configured using the inflatable seals, which may respond to various fluid pressures applied to the wellbore tubular.

A plurality of flow control devices may be incorporated into a completion string at different points along the completion string, and the in-flow characteristics of each flow control device may be independently adjusted interventionlessly from the surface, by pumping a selected pressure into the interior of the tubular at the surface. Thus, various flow states, resistances to flow, or flow control device configurations in one or more flow control devices are possible using only fluid pressure applied to the wellbore tubular interior. The transition between the various configurations may be useful over the lifetime of the flow control device, and the actuation of the inflatable seals may be separated by a period of days, months, or even years.

Referring to FIG. 1, an example of a wellbore operating environment in which a flow control device may be used is shown. As depicted, the operating environment comprises a workover and/or drilling rig 106 that is positioned on the earth's surface 104 and extends over and around a wellbore 114 that penetrates a subterranean formation 102 for the purpose of recovering hydrocarbons. The wellbore 114 may be drilled into the subterranean formation 102 using any suitable drilling technique. The wellbore 114 extends substantially vertically away from the earth's surface 104 over a vertical wellbore portion 116, deviates from vertical relative to the earth's surface 104 over a deviated wellbore portion 136, and transitions to a horizontal wellbore portion 117. In alternative operating environments, all or portions of a wellbore may be vertical, deviated at any suitable angle, horizontal, and/or curved. The wellbore may be a new wellbore, an existing wellbore, a straight wellbore, an extended reach wellbore, a sidetracked wellbore, a multi-lateral wellbore, and other types of wellbores for drilling and completing one or more production zones. Further, the wellbore may be used for both producing wells and injection wells.

A wellbore tubular string 120 may be lowered into the subterranean formation 102 for a variety of drilling, completion, workover, treatment, and/or production processes throughout the life of the wellbore. The embodiment shown in FIG. 1 illustrates the wellbore tubular string 120 in the form of a completion assembly string disposed in the wellbore 114. It should be understood that the wellbore tubular 120 is equally applicable to any type of wellbore tubulars being inserted into a wellbore including as non-limiting examples drill pipe, casing, liners, jointed tubing, and/or coiled tubing. Further, the wellbore tubular string 120 may operate in any of the wellbore orientations (e.g., vertical, deviated, horizontal, and/or curved) and/or types described herein. In an embodiment, the wellbore may comprise wellbore casing 112, which may be cemented into place in the wellbore 114.

In an embodiment, the wellbore tubular string 120 may comprise a completion assembly string comprising one or more wellbore tubular types and one or more downhole tools (e.g., zonal isolation devices 118, screens, valves, etc.). The one or more downhole tools may take various forms. For example, a zonal isolation device 118 may be used to isolate the various zones within a wellbore 114 and may include, but is not limited to, a packer (e.g., production packer, gravel pack packer, frac-pac packer, etc.). In an embodiment, the wellbore tubular string 120 may comprise a plurality of well screen assemblies 122, which may be disposed within the horizontal wellbore portion 117. The zonal isolation devices 118, may be used between various ones of the well screen assemblies 122, for example, to isolate different zones or intervals along the wellbore 114 from each other.

The workover and/or drilling rig 106 may comprise a derrick 108 with a rig floor 110 through which the wellbore tubular string 120 extends downward from the drilling rig 106 into the wellbore 114. The workover and/or drilling rig 106 may comprise a motor driven winch and other associated equipment for conveying the wellbore tubular string 120 into the wellbore 114 to position the wellbore tubular string 120 at a selected depth. While the operating environment depicted in FIG. 1 refers to a stationary workover and/or drilling rig 106 for conveying the wellbore tubular string 120 within a land-based wellbore 114, in alternative embodiments, mobile workover rigs, wellbore servicing units (such as coiled tubing units), and the like may be used to convey the wellbore tubular string 120 within the wellbore 114. It should be understood that a wellbore tubular string 120 may alternatively be used in other operational environments, such as within an offshore wellbore operational environment.

The flow control device described herein allows for the resistance to flow and/or the flow rate through the flow control device to be selectively adjusted. The flow control device described herein generally comprises a flow restriction disposed in a fluid pathway between an exterior of a wellbore tubular and an interior of the wellbore tubular. The flow control device further comprises a one-way valve disposed in the fluid pathway that substantially blocks or prevents fluid flow in one direction and promotes fluid flow in another direction through the fluid pathway. By creating a pressure differential from an interior of the flow control device to an exterior of the flow control device, a state wherein the one-way valve substantially blocks flow through the fluid pathway, the flow control device can be adjusted by selectively building to a selected threshold pressure differential.

Figure 2A:
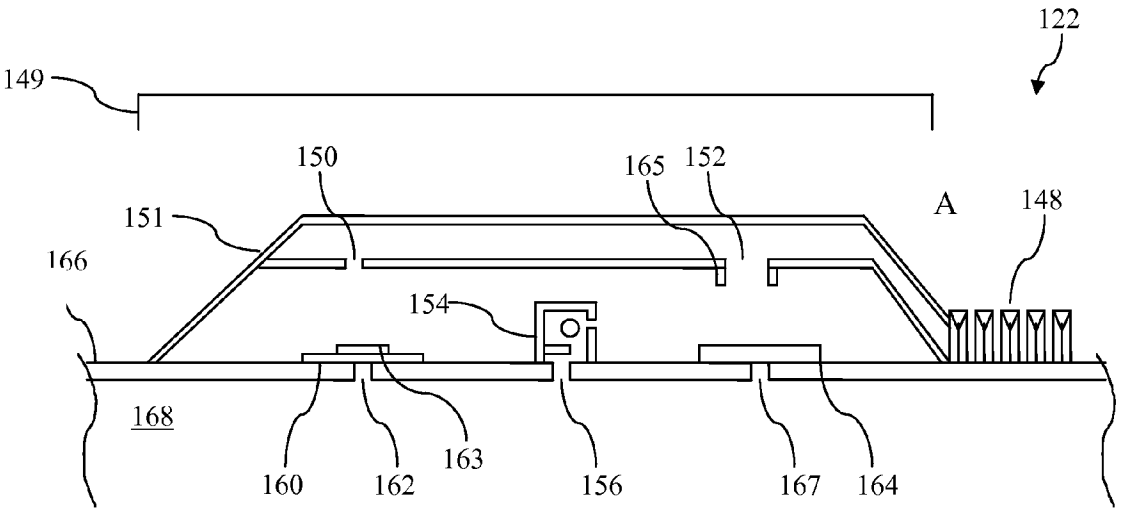
FIG. 2A is an illustration of a flow control device according to an embodiment of the disclosure.

Referring now to FIG. 2A, FIG. 2B, FIG. 2C, and FIG. 2D, a schematic partially cross-sectional view of one of the well screen assemblies 122 comprising a flow control device is representatively illustrated at an enlarged scale. The well screen assembly 122 generally comprises a filter portion 148 and a flow control device 149. The filter portion 148 is used to filter at least a portion of any sand and/or other debris from a fluid that generally flows from an exterior to an interior of the screen assembly 122. The filter portion 148 is depicted in FIG. 2A as being of the type known as "wire-wrapped," since it is made up of a wire closely wrapped helically about a wellbore tubular, with a spacing between the wire wraps being chosen to keep sand and the like that is greater than a selected size from passing between the wire wraps. Other types of filter portions (such as sintered, mesh, pre-packed, expandable, slotted, perforated, etc.) may also be used. It is understood that FIGS. 2A-2D show a partial view of the well screen assembly 122. The well screen assembly 122 is coupled into the wellbore tubular string 120 at both ends, for example using threaded couplings. The size of components illustrated in FIGS. 2A-2D are not drawn to scale and are not intended to represent specific proportions one to the other. The size of the filter portion 148 illustrated in FIGS. 2A-2D is not meant to indicate a proportion to the flow control device 149.

The flow control device 149 may perform several functions. In an embodiment, the flow control device 149 comprises an ICD which functions to restrict flow there through, for example, to balance production of fluid along an interval. In an embodiment, the flow control device 149 generally comprises a first flow restriction 150 and a second flow restriction 152 disposed within a fluid pathway between an exterior A of the wellbore tubular 166 and an interior throughbore 168 of the wellbore tubular 166. In an embodiment, the flow restrictions 150, 152 are disposed within a housing 151. The housing 151 can comprise a generally cylindrical member disposed about a portion of the wellbore tubular 166. The housing 151 may be fixedly engaged with the wellbore tubular 166 and one or more seals may be disposed between the housing 151 and the exterior surface of the wellbore tubular 166 to provide a substantially fluid tight engagement between the housing 151 and the wellbore tubular 166.

The flow restrictions 150, 152 may generally be disposed within the fluid pathway. The first flow restriction 150 may be configured to provide a first desired resistance to fluid flow through the flow restriction 150, and the second flow restriction 152 may be configured to provide a second desired resistance to fluid flow through the second flow restriction 152. The first and second desired resistance may be different in some embodiments or may be the same in other embodiments. The flow restrictions 150, 152 may be selected to provide a resistance for balancing the production along an interval. Various types of flow restrictions 150, 152 can be used with the flow control device 149 described herein. In the embodiment shown in FIG. 2A, the flow restrictions 150, 152 comprise a nozzle that comprises a central opening (e.g., orifice) for creating the resistance and pressure drop in a fluid flowing through the flow restrictions 150, 152. To provide different desired flow resistances, the diameter of the central openings of flow restrictions 150, 152 may be different. Other suitable flow restrictions may also be used including, but not limited to, narrow flow tubes, annular passages, bent tube flow restrictors, helical tubes, and the like. Narrow flow tubes may comprise any tube having a ratio of length to diameter of greater than about 2.5 and providing for the desired resistance to flow. Similarly, annular passages comprise narrow flow passages that provide a resistance to flow due to frictional forces imposed by surfaces of the fluid pathway. A bent tube flow restrictor comprises a tubular structure that forces fluid to change direction as it enters and flows through the flow restrictor. Similarly, a helical tube flow restrictor comprises a fluid pathway that forces the fluid to follow a helical flow path as it flows through the flow restrictor. The repeated change of momentum of the fluid through the bent tube and/or helical tube flow restrictors increases the resistance to flow and can allow for the use of a larger flow passage that may not clog as easily as the narrow flow passages of the narrow flow tubes and/or annular passages. Each of these different flow restriction types may be used to provide a desired resistance to flow and/or pressure drop for a fluid flow through the flow restrictor. Since the resistance to flow may change based on the type of fluid, the type of flow restriction may be selected to provide the desired resistance to flow for one or more type of fluid.

The flow restriction can be subject to erosion and/or abrasion from fluids passing through the flow restriction. Accordingly, the flow restriction, or at least those portions contacting the fluid flow can be formed from any suitable erosion and/or abrasion resistant materials. Suitable materials may comprise various hard materials such as various steels, tungsten, niobium, vanadium, molybdenum, silicon, titanium, tantalum, zirconium, chromium, yttrium, boron, carbides (e.g., tungsten carbide, silicon carbide, boron carbide), nitrides (e.g., silicon nitride, boron nitride), oxides, silicides, alloys thereof, and any combinations thereof. In an embodiment, one or more of these hard materials may form a portion of a composite material. For example, the hard materials may form a particulate or discontinuous phase useful in resisting erosion and/or abrasion, and a matrix material may bind the hard particulate phase. Suitable matrix materials may comprise copper, nickel, iron, cobalt, alloys thereof, and any combination thereof. Since machining hard, abrasion, erosion and/or wear resistant materials is generally both difficult and expensive, the flow restrictions may be formed from a metal in a desired configuration and subsequently one or more portions of the flow restriction may be treated to provide the desired abrasion, erosion and/or wear resistance. Suitable surface treatments used to provide erosion and/or abrasion resistance can include, but are not limited to, carburizing, nitriding, heat treating, and any combination thereof. In embodiments in which erosion and/or abrasion is not a concern, additional suitable materials such as various polymers may also be used.

The flow control device 149 further comprises a one-way valve 154 that permits one-way flow from the housing 151 through a flow port 156 into the interior throughbore 168. While illustrated in FIG. 2 as a captive ball check valve, in other embodiments a different kind of one-way valve may be employed, for example a flapper type check valve or another type of check valve. The flow control device 149 further comprises a first seal 160 located between a first closure port 162 and the interior of the housing 151 and a second seal 164 located between a second closure port 167 and the interior of the housing 151. In an embodiment, the seals 160, 164 may comprise metal seals. Alternatively, in another embodiment, the seals 160, 164 may comprise plastic seals. In an embodiment, one of the seals 160, 164 may comprise a metal seal and the other may comprise a plastic seal.

The first seal 160 is configured to inflate and at least partially block the first flow restriction 150 when a differential pressure of at least a first threshold is presented between the interior throughbore 168 and the exterior A of the flow control device 149. The second seal 164 is configured to inflate and at least partially block the second flow restriction 152, when a differential pressure of at least a second threshold is presented between the interior throughbore 168 and the exterior A of the flow control device 149. In an embodiment, deformable material may be placed to promote sealing of the seal 160, 164 with the flow restriction 150, 152. The deformable material may be placed on the seal 160, 164 as illustrated by a first deformable material 163 or on the flow restriction 150, 152 as illustrated by a second deformable material 165. In an embodiment, deformable material may be located on both the seal 160, 164 and the flow restriction 150, 152.

While two flow restrictions 150, 152, two seals 160, 164, two closure ports 162, 167, and two deformable materials 163, 165 are illustrated in FIG. 2A, it is understood that any number of these structures may be provided with the flow control device 149. The embodiment of the flow control device 149 illustrated in FIGS. 2A-2D may be said to provide three different in-flow control states: fully open, reduced flow or restricted flow, and fully closed. Note that in the fully open state, in-flow is determined by the flow restrictions 150, 152. In the reduced flow state or restricted flow state, in-flow is reduced or attenuated by the closure or blockage of one of the flow restrictions 150, 152. In the fully closed state, all flow restrictions 150, 152 of the flow control device 149 are closed. Note that in the fully closed state of the flow control device 149 some fluid may flow through the flow restrictions 150, 152 due to the imperfection of the sealing and/or closure of the flow restrictions 150, 152. If more than two flow restrictions 150, 152 are implemented in the flow control device 149 along with additional corresponding seals and closure ports, the flow control device 149 may provide more than three different in-flow control states and/or a plurality of reduced flow or restricted flow states may be possible.

Figure 2B:
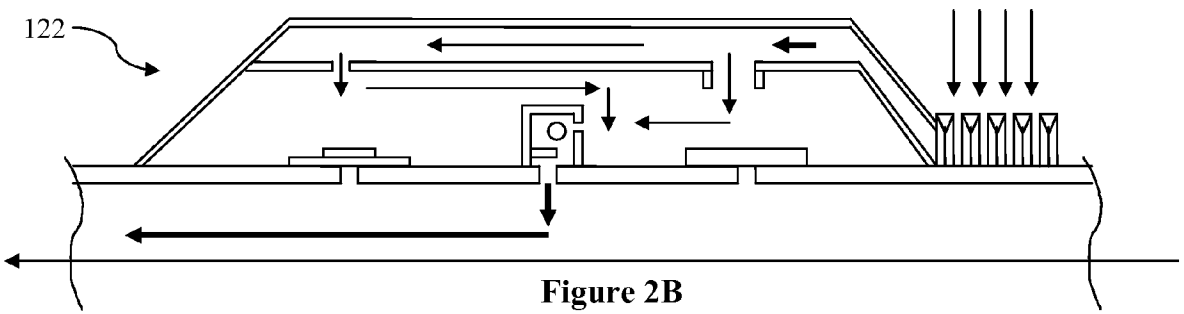
FIG. 2B is an illustration of a flow control device in a first operational state according to an embodiment of the disclosure.

Turning now to FIG. 2B, the fully open state of the flow control device 149 is illustrated. The seals 160, 164 are not inflated and the flow restrictions 150, 152 are not blocked. Fluid flows from the exterior of the well screen assembly 122, through the screen 148, into the housing 151, through the first flow restriction 150, through the second flow restriction 152, through the one-way valve 154, through the flow port 156, and into the throughbore 168. The fluid may be a hydrocarbon such as natural gas or crude oil. The fluid may comprise other substances in the liquid phase such as water and other substances. While the state of the flow control device 149 illustrated in FIG. 2B may be referred to as the fully open state, it is noted that the fluid flow rate may be restricted by the flow restrictions 150, 152, for example restricted by the diameter or cross sectional area of the flow restrictions 150, 152 which may be determined at design time, during manufacturing, and/or at the surface before running the well screen assembly 122 into the wellbore 114.

Figure 2C:
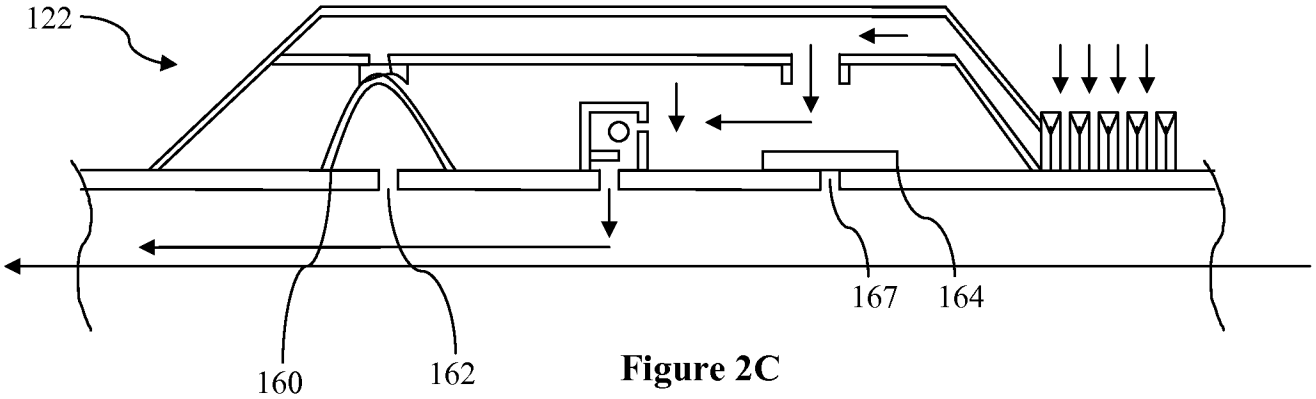
FIG. 2C is an illustration of a flow control device in a second operational state according to an embodiment of the disclosure.

Turning now to FIG. 2C, the reduced flow state of the flow control device 149 is illustrated. The first seal 160 has been inflated so that it at least partially blocks the first flow restriction 150. Note that even if the first seal 160 does not completely block the first flow restriction 150 and if some fluid flows through the first flow restriction 150, the fluid flow through the first flow restriction 150 may still be reduced or attenuated. In an embodiment a deformable material, for example a rubber material, is located between the first seal 160 and the first flow restriction 150 to promote improved sealing. In an embodiment, a first deformable material 163 may be coupled to the seal 160, 164 between the first seal 160, 164 and the flow restriction 150, 152. In another embodiment, a second deformable material 165 may be coupled to the edge of the flow restriction 150, 152 for example on the edge of the flow restriction 150, 152.

As illustrated in FIGS. 2A-2D, the first flow restriction 150 is smaller in cross sectional area than the second flow restriction 152 and hence the first flow restriction 150 may be expected to allow a lower rate of fluid flow than the second flow restriction 152. Suppose under some production condition that the fluid flow through the first flow restriction 150 may be about 1 volume per unit time, the fluid flow through the second flow restriction 152 may be about 2 volumes per unit time, and the total flow through the one-way valve 154 may be about 3 volumes per unit time in the fully open state of the flow control device 149 illustrated in FIG. 2B. Under the same production condition, when the flow control device 149 is in the reduced flow state as illustrated in FIG. 2C, the flow through the second flow restriction 152 may be about 2 volumes per unit time and the flow through the one-way valve 154 may be about 2 volumes per unit time. Thus, the interventionless adjustment has reduced the in-flow of fluid through the flow control device 149 by about 33%.

It will be appreciated that in an alternative embodiment the second seal 164 may be configured and/or designed to inflate at a pressure differential that is lower than the threshold inflation pressure associated with the first seal 160. In such an embodiment, the interventionless adjustment may reduce the flow rate through the flow control device 149 by about 67%. Additionally, in another embodiment featuring more than two flow restrictions and more than two seals, still other fractional reductions of flow rates could be provided by the flow control device 149. All these alternatives are contemplated by the present disclosure.

Figure 2D:
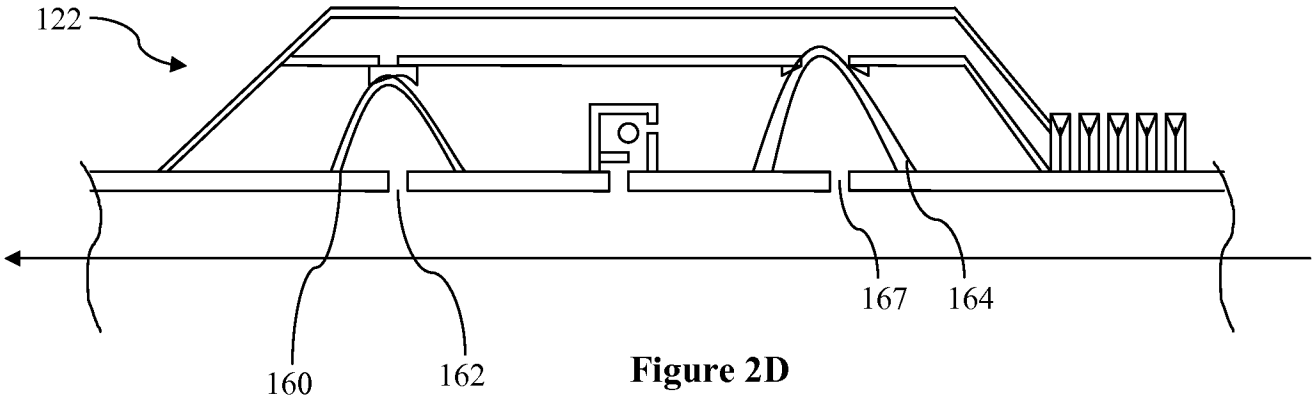
FIG. 2D is an illustration of a flow control device in a third operational state according to an embodiment of the disclosure.

Turning now to FIG. 2D, the fully closed state of the flow control device 149 is illustrated. The first seal 160 remains inflated and blocks the first flow restriction 150 and the second seal 164 has been inflated and blocks the second flow restriction 152. Because all the illustrated flow restrictions are blocked, flow from the exterior A of the well screen assembly 122 to the interior throughbore 168 is substantially blocked and stopped. It is understood, however, that the blockage of the first flow restriction 150 by the first seal 160 and the blockage of the second flow restriction 152 by the second seal 164 may be imperfect and some fluid flow may flow through the one-way flow control valve 154. As with the first seal 160 and the first flow restriction 150, the seal between the second seal 164 and the second flow restriction 152 may be improved by an interposed deformable material, for example a rubber material.

By making the seals 160, 164 of different thickness and/or of materials having different elasticity, one seal may be configured to inflate at a different pressure differential than the other seal. In an embodiment, the seals 160, 164 may inflate at about the same threshold of differential pressure. In another embodiment, the seals 160, 164 inflate at different thresholds of differential pressure, for example thresholds that are different by at least about 200 PSI, by at least about 500 PSI, by at least about 1000 PSI, or at least about by integer multiples of one of 200 PSI, 500 PSI, or 1000 PSI. In an embodiment, the seals 160, 164 inflate at a differential pressure that is less than about 20,000 PSI, less than about 15,000 PSI, or less than about 10,000 PSI. In an embodiment, the seals 160, 164 inflate at a differential pressure that is less than a burst pressure of the wellbore tubular 166, that is less than a proof test pressure of the wellbore tubular 166, or that is less than another pressure failure parameter associated with the wellbore tubular 166. In an embodiment, the first seal 160 may be configured to inflate in response to an about 1000 PSI pressure differential from the interior throughbore 168 to the exterior A of the well screen assembly 122 and the second seal 164 may be configured to inflate in response to an about 1500 PSI pressure differential from the interior throughbore 168 to the exterior A of the well screen assembly 122. In this example, a first pressure threshold associated with the first seal 160 may be said to be about 1000 PSI while a second pressure threshold associated with the second seal 164 may be said to be about 1500 PSI. Alternatively, the first seal 160 may be configured to inflate at about a 1000 PSI pressure differential while the second seal 164 may be configured to inflate in response to an about 2000 PSI pressure differential. In this example, the first pressure threshold associated with the first seal 160 may be said to be about 1000 PSI while the second pressure threshold associated with the second seal 164 may be said to be about 2000 PSI.

Figure 3C:
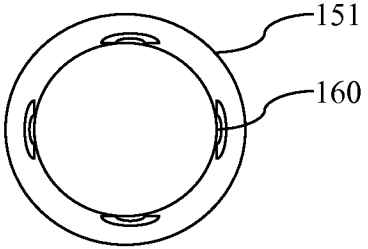
FIG. 3C is an illustration of an inflatable seal of a flow control device in a non-inflated state according to another embodiment of the disclosure.
Figure 3D:
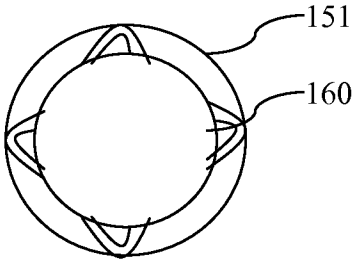
FIG. 3D is an illustration of an inflatable seal of a flow control device in an inflated state according to another embodiment of the disclosure.
Figure 3A:
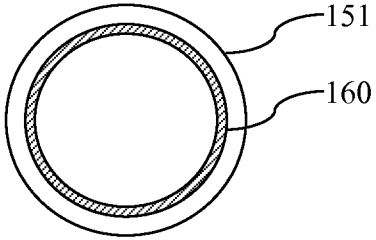
FIG. 3A is an illustration of an inflatable seal of a flow control device in a non-inflated state according to an embodiment of the disclosure.
Figure 3B:
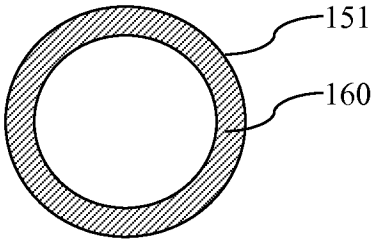
FIG. 3B is an illustration of an inflatable seal of a flow control device in an inflated state according to an embodiment of the disclosure.

While the first seal 160 is illustrated as on the opposite side of the one-way valve 154 as is the second seal 164, in another embodiment both seals 160, 164 may be located on either the right of the one-way valve 154 or both seals 160, 164 may be located on the left of the one-way valve 154. In an embodiment, the seals 160, 164 may be implemented as metal bands or strips that circumferentially encircle the wellbore tubular 166. When one of the seals 160, 164 inflates it may effectively block flow from a side of the seal facing away from the one-way flow valve 154. In this case, the location of the seals 160, 164 may desirably be located so a seal having a lower pressure threshold may not isolate a seal having a higher pressure threshold from the one-way flow valve 154. This may best be seen in FIG. 3A and FIG. 3B. In FIG. 3A, the first seal 160 is shown in its non-inflated state, and a gap or flow path is shown between the first seal 160 and the housing 151. In FIG. 3B, the first seal 160 is shown in its inflated state, and the gap or flow path visible in FIG. 3A has been closed or at least partially closed.

In an alternative embodiment, the seals 160, 164 may be implemented as metal bands or strips that only partially encircle the wellbore tubular 166. In this embodiment, the inflation of a seal 160, 164 may block a corresponding flow restriction 150, 152 but may not isolate a non-corresponding flow restriction 150, 152. This may best be seen in FIG. 3C and FIG. 3D. In FIG. 3C, the first seal 160 is shown in its non-inflated state, and a gap or flow path is shown between the first seal 160 and the housing 151. In FIG. 3D, the first seal 160 is shown in its inflated state, but a gap or flow path between the first seal 160 and the housing 151 remains substantially open.

It is noted that a plurality of first flow restrictions 150 that are substantially similar to each other may be located in a first circumferential band around the flow control device 149 and a plurality of second flow restrictions 152 that are substantially similar to each other may be located in a second circumferential band around the flow control device 149. The seals 160, 164 may be welded to the wellbore tubular 166, bonded to the wellbore tubular 166 using an adhesive (e.g., an epoxy), threaded to the wellbore tubular 166, or otherwise coupled to the wellbore tubular 166.

Figure 4:
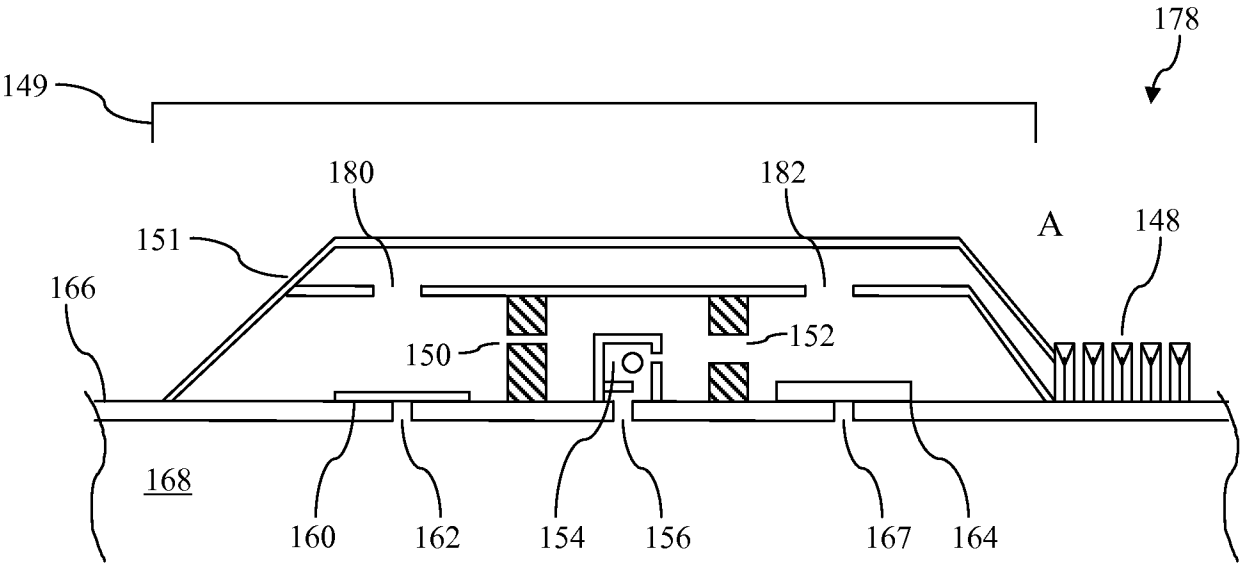
FIG. 4 is an illustration of another flow control device according to an embodiment of the disclosure.

Turning now to FIG. 4, an alternative embodiment of the well screen assembly 122 is described. A second well screen assembly 178 is substantially similar to the well screen assembly 122 described above with reference to FIGS. 2A, 2B, 2C, 2D, 3A, 3B, 3C, and 3D. The second well screen assembly 178 differs in that the flow restrictions 150, 152 are oriented and located differently than the well screen assembly 122 illustrated in FIGS. 3A, 3B, 3C, 3D. In the second well screen assembly 178, a first port 180 provides a portion of a fluid pathway to produce fluid via the first restriction 150, and a second port 182 provides a portion of a fluid pathway to produce fluid via the second restriction 152. The deformable material 163, 165 described above may be used in this alternative embodiment to promote sealing between the seals 160, 164 and the ports 180, 182.

It is understood that the length of the well screen assemblies 122, 178 is not represented proportionally in FIGS. 2A, 2B, 2C, 2D, and 4. Thus, the distance between the first flow restriction 150 and the one-way valve 154 and between the second flow restriction 152 and the one-way valve 154 may be sufficient in the manufactured second well screen assembly 178 for any nozzle acceleration effects of fluid passing through the restrictions 150, 152 to be dampened so that fluid cutting of the one-way valve 154 is not a significant problem.

In an embodiment, the flow control device 149 may be selectively adjusted based on a determination of a desired fluid resistance and/or flow rate through the flow control device 149. In general, the fluid resistance and/or flow rate through a flow control device may be selected to balance the production of fluid along an interval, for example to balance the production of fluid from the plurality of well screen assemblies 122 in the wellbore tubular string 120 illustrated in FIG. 1. The determination of the fluid resistance and/or flow rate for an interval may be determined based on the desired production from the interval and the expected conditions within the interval including, but not limited to, the permeability of the formation within the interval, the total length of the interval, the types of fluids being produced from the interval, and/or the fluid properties of the fluids being produced in the interval. Once a desired fluid resistance and/or flow rate for an interval is determined, the flow control device may be selectively adjusted by installing and/or removing one or more flow restrictions 150, 152 at the surface prior to running in the well screen assemblies 122, for example flow restrictions having different cross sectional areas.

Once run into the wellbore 114, sensors (not shown) coupled to the wellbore tubular string 120 and/or the well screen assemblies 122 may transmit sensor data to the surface that can be evaluated to determine actual in-flow fluid rates associated with each of the well screen assemblies 122. Additionally, various logging tools may be run into and retrieved from the wellbore tubular string 120 to capture downhole data at one or more times during the production life cycle of the wellbore 114. Over the production life of the wellbore 114, the in-flow fluid rates may change and become imbalanced. The flow control devices 149 may be interventionlessly adjusted from the surface by driving a controlled pressure down the wellbore tubular string 120 to cause one or more seals 160, 164 to inflate and thereby selectively change the in-flow rates at different locations along the wellbore tubular string 120. For example, if hydrocarbon fluids are depleted and water is being produced at one well screen assembly 122, for example the well screen assembly 122 closest to the surface 104, the flow control device 149 associated with the subject well screen assembly 122 may be adapted to the fully closed state, thereby blocking or attenuating the production of water at that well screen assembly 122. The interventionless adjustments of the flow control devices 149 may be performed during an initial completion initialization state of production, at a time 5 years into production, and at yet later times during production.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. For example, the locations of the flow restrictions 150, 152 could be changed. For example the first flow restriction 150 that is represented in FIG. 2 as being located uphole with reference to the second flow restriction 152 could instead be located downhole with reference to the second flow restriction 152. For example, the one-way valve 154 that is represented in FIG. 2 as having an opening facing downhole may instead be oriented to have the opening oriented uphole or oriented at an angle out of parallel with the center axis of the wellbore tubular 166. The flow control device 149 that is represented in FIG. 2 as being located uphole with reference to the filter portion 148 could instead be located downhole with reference to the filter portion 148. One skilled in the art will readily appreciate that a large number of alternative arrangements and dispositions of parts are taught and contemplated by the present disclosure, the which are not exhaustively cataloged here in the interests of providing a concise disclosure.

Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_1$, and an upper limit, $R_u$, is disclosed, any number falling within the range is specifically disclosed. In particular, the following numbers within the range are specifically disclosed: $R=R_1+k(*(R_u-R_1)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A flow control device comprising:

a fluid pathway configured to provide fluid communication between an exterior of a wellbore tubular and an interior of the wellbore tubular;

a flow restriction disposed in the fluid pathway;

a one-way valve disposed in the fluid pathway to substantially block fluid flow from the interior of the wellbore tubular to the fluid pathway and to allow fluid flow from the fluid pathway to the interior of the wellbore tubular;

an inflatable seal disposed between an opening to the interior of the wellbore tubular and the fluid pathway, wherein the inflatable seal is configured to inflate with at least partial inelastic deformation to substantially block fluid flow through the flow restriction in response to a first fluid pressure differential between the interior of the wellbore tubular and the exterior of the wellbore tubular that exceeds a predefined threshold, wherein the inflatable seal is further configured to radially inflate substantially in-line with the flow restriction and directly contact the flow restriction to substantially block fluid flow through the flow restriction;

a second flow restriction disposed in the fluid pathway; and a second inflatable seal disposed between a second opening to the interior of the wellbore tubular and the fluid pathway and configured to inflate with at least partial inelastic deformation to substantially block fluid flow through the second flow restriction in response to a second fluid pressure differential between the interior of the wellbore tubular and the exterior of the wellbore tubular that exceeds a second predefined threshold, where the second predefined threshold is greater than the predefined threshold, and wherein the second flow restriction is open to fluid flow when the flow restriction is substantially blocked and prior to the fluid pressure differential exceeding the second predefined threshold.

2. The flow control device of claim 1, further comprising a filter portion disposed in the fluid pathway between the exterior of the wellbore tubular and the interior of the wellbore tubular.

3. The flow control device of claim 1, wherein the second predefined threshold is more than about 500 PSI greater than the predefined threshold or the predefined threshold is more than about 500 PSI greater than the second predefined threshold.

4. The flow control device of claim 1, further comprising a deformable material disposed on the inflatable seal, wherein the deformable material is configured to engage the flow restriction when the inflatable seal is inflated.

5. The flow control device of claim 1, wherein a deformable material is coupled to the flow restriction, and wherein the deformable material is configured to engage the inflatable seal when the inflatable seal is inflated.

6. The flow control device of claim 1, wherein the inflatable seal is configured to remain inflated and to continue to substantially block the flow restriction after the inflatable seal has been inflated and after the fluid pressure differential between the interior of the wellbore tubular and the exterior of the wellbore tubular has dropped below the predefined threshold.

7. The flow control device of claim 1, wherein the inflatable seal comprises a circumferential band coupled to the wellbore tubular.

8. The flow control device of claim 7, further comprising at least one additional flow restriction, wherein the inflatable seal is configured to inflate to substantially block the at least one additional flow restriction at the same time that it blocks the flow restriction.

9. The flow control device of claim 1, wherein a deformable material located between the flow restriction and the inflatable seal seals fluid production through the first flow restriction.

10. A method comprising:

producing a fluid in a wellbore through a flow control device to an interior of a wellbore tubular, wherein the flow control device comprising at least one fluid pathway between an exterior of a wellbore tubular and an interior of the wellbore tubular, a port disposed in the fluid pathway, a one-way flow valve disposed to substantially block fluid flow from the interior of the wellbore tubular to the fluid pathway and to allow fluid flow from the fluid pathway to the interior of the wellbore tubular, and an inflatable seal disposed between an opening to the interior of the wellbore tubular and the fluid pathway;

providing a pressure differential above a predefined threshold between the interior of the wellbore tubular and the exterior of the wellbore tubular;

inflating the inflatable seal in response to the pressure differential above the predefined threshold, wherein the inflatable seal is further configured to radially inflate substantially in-line with the flow restriction and directly contact the flow restriction to substantially block fluid flow through the flow restriction; and substantially blocking fluid production through the port subsequent to providing the pressure differential by at least partial inelastic deformation of the inflatable seal in response to inflating the inflatable seal, wherein substantially blocking fluid production through the port comprises engaging a deformable material coupled to the port with the inflatable seal, wherein the inflatable seal at least partially inelastically deforms in response to inflating the inflatable seal.

11. The method of claim 10, wherein the flow control device comprises a second port disposed in the fluid pathway and a second inflatable seal disposed between a second opening to the interior of the wellbore tubular and the fluid pathway, wherein the method further comprises producing the fluid through the second port after substantially blocking fluid production through the port.

12. The method of claim 11, further comprising:

providing a pressure differential above a second predefined threshold between the interior of the wellbore tubular and the exterior of the wellbore tubular, wherein the second predefined threshold is different from the predefined threshold;

inflating the second inflatable seal in response to the pressure differential about the second predefined threshold; and substantially blocking fluid production through the second port by the second inflatable seal in response to inflation of the second inflatable seal.

13. The method of claim 10, wherein substantially blocking fluid production through the port further comprises engaging a deformable material coupled to the inflatable seal with the port in response to inflating the inflatable seal.

14. The method of claim 10, wherein the fluid that is produced comprises a hydrocarbon.

15. A method of adjusting fluid resistance to flow comprising:

producing a fluid in a wellbore through a first flow control device comprising at least one fluid pathway between an exterior of a first wellbore tubular and an interior of the first wellbore tubular, a flow restriction disposed in the fluid pathway, a first one-way flow valve disposed to substantially block fluid flow from the interior of the first wellbore tubular to the fluid pathway and to allow fluid flow from the fluid pathway to the interior of the first wellbore tubular, and a first inflatable seal disposed between an opening to the interior of the first wellbore tubular and the fluid pathway;

producing a fluid in the wellbore through a second flow control device comprising a second wellbore tubular, wherein the first flow control device is coupled to the second flow control device by a portion of a tool string and wherein the interior of the first wellbore tubular and the interior of the second wellbore tubular are in fluid communication with each other;

inflating the first inflatable seal in response to a pressure differential above a first predefined threshold between the interior of the first wellbore tubular and the exterior of the first wellbore tubular, wherein inflating the inflatable seal comprises radially inflating the inflatable seal substantially in-line with the flow restriction and directly contacting the flow restriction; and substantially blocking fluid production through the flow restriction subsequent to the pressure differential by at least partial inelastic deformation of the first inflatable seal in response to inflating the first inflatable seal, wherein a deformable material located between the first flow restriction and the first inflatable seal seals fluid production through the first flow restriction.

16. The method of claim 15, wherein the second flow control device comprises at least one second fluid pathway between an exterior of the second wellbore tubular and an interior of the second wellbore tubular, a second flow restriction disposed in the second fluid pathway, a second one-way flow valve disposed to substantially block fluid flow from the interior of the second wellbore tubular to the second fluid pathway and to allow fluid flow from the second fluid pathway to the interior of the second wellbore tubular, and a second inflatable seal disposed between an opening to the interior of the second wellbore tubular and the second fluid pathway.

17. The method of claim 16, further comprising providing a pressure differential above a second threshold between the interior of the second wellbore tubular and the exterior of the second wellbore tubular, wherein the second predefined threshold is greater than the first predefined threshold;

inflating the second inflatable seal in response to the pressure differential above the second predefined threshold; and substantially blocking fluid production through the second flow restriction by the second inflatable seal in response to inflation.

18. The method of claim 15, wherein the first inflatable seal is a metal inflatable seal.

19. The method of claim 15, wherein substantially blocking fluid production through the flow restriction comprises engaging a deformable material coupled to the inflatable seal with the flow restriction in response to inflating the inflatable seal.

20. The method of claim 15, wherein substantially blocking fluid production through the flow restriction comprises engaging a deformable material coupled to the flow restriction with the inflatable seal in response to inflating the inflatable seal.

* * * * *